US005614994A

United States Patent [19]

Kreiter

[11] Patent Number: 5,614,994

[45] Date of Patent: Mar. 25, 1997

[54] DEVELOPER STATION FOR AN ELECTROPHOTOGRAPHIC PRINTING OR COPYING MACHINE

[75] Inventor: Alexander Kreiter, Hofsingelding, Germany

[73] Assignee: Siemens Nixdorf Informationssysteme Aktiengesellschaft, Paderborn, Germany

[21] Appl. No.: 379,504

[22] PCT Filed: Jul. 16, 1993

[86] PCT No.: PCT/EP93/01876

§ 371 Date: Apr. 19, 1995

§ 102(e) Date: Apr. 19, 1995

[87] PCT Pub. No.: WO94/03842

PCT Pub. Date: Feb. 17, 1994

[30] Foreign Application Priority Data

Jul. 30, 1992 [DE] Germany ..... 92113025.8

[51] Int. Cl.[6] ..... G03G 15/09; G03G 15/08

[52] U.S. Cl. ..... 399/256; 399/260; 399/269

[58] Field of Search ..... 355/251, 245; 118/657, 658, 653

[56] References Cited

U.S. PATENT DOCUMENTS

| | | | |
|---|---|---|---|
| 4,003,335 | 1/1977 | Kurita et al. | 118/658 |
| 4,076,857 | 2/1978 | Kasper et al. | 430/103 |
| 4,952,979 | 8/1990 | Koefferlein et al. | 355/251 |
| 5,023,664 | 6/1991 | Koefferlein et al. | 355/245 |

FOREIGN PATENT DOCUMENTS

| | | |
|---|---|---|
| 0265942 | 5/1988 | European Pat. Off. . |
| 0430098 | 6/1991 | European Pat. Off. . |
| 2522052 | 5/1975 | Germany . |
| 2226156 | 6/1990 | United Kingdom . |

*Primary Examiner*—Joan H. Pendegrass
*Assistant Examiner*—Quana Grainger
*Attorney, Agent, or Firm*—Hill, Steadman & Simpson

[57] ABSTRACT

A developer station for an electrophotographic printing or copying machine has a developer chamber (12), a mixing chamber (13) and a developer-station sump (14) connected to the two chambers. Two developer-mixture circuits are produced in the developer station, namely a developer-mixture circuit for receiving fresh toner and a developer-mixture circuit for the actual development in a developer gap (18). A paddle roller (37) arranged in the developer-station sump (14) generates, in the outlet region of the mixing chamber (13), a mixture vortex which is enriched with fresh toner and from which developer mixture is extracted continuously for the development process. The mixture vortex serves essentially as a buffer store for compensating a high toner requirement during development and, in conjunction with the mixing chamber (13), for the triboelectric activation of the developer mixture.

18 Claims, 2 Drawing Sheets

DEVELOPER STATION FOR AN ELECTROPHOTOGRAPHIC PRINTING OR COPYING MACHINE

BACKGROUND OF THE INVENTION

The present invention is directed to an electrophotographic printing or copying means having a developer region for developing an image on a charge image. The present invention is more specifically directed to such a printing or copying means using a developer mix of toner particles and carrier particles.

In electrophotographic printing or copying machines, a latent charge image is generally generated on a photoconductor by means of an optical character generator which can, for example, be an LED character generator, and this charge image is then tinted with toner particles in a developer station. The black and also colored toner particles are charged electrostatically and are applied continuously to the photoconductor in a developer gap. The, for example, positively charged toner is attracted by the exposed places on the charge image, whilst the unexposed positively charged surfaces repel it.

When "negative toner" is used, the photoconductor layer is likewise negatively charged and is exposed with the characters to be developed. Both uses are referred to as reversal development.

So that the toner particles adhere to the charge image, they are triboelectrically charged. This triboelectric charging takes place primarily triboelectrically as a result of the friction of the particles on one another in the developer station. The quality of the subsequent character image depends essentially on this interaction of electrostatic and Van der Waals forces. The development process, including the toner feed and regulation with the toner materials used as well as the constructive design of the developer station are therefore some of the most complex structures in an electrophotographic printing or copying machine.

The developer mixture used most frequently is a two-component mixture of toner and of ferromagnetic carrier particles. The two components are intermixed in the developer station and are applied to the photoconductor in the developer gap via a developer roller designed as a magnetic roller. In view of the special properties of the toner and of the carrier material, the mixing operation brings about a charging of the toner which is caused by frictional electricity (triboelectricity). The development operation can be assisted by a bias voltage additionally applied in the region of the developer gap.

Developer stations of the type mentioned are known, for example, from U.S. Pat. No. 5,023,664 or U.S. Pat. No. 4,952,279.

Furthermore, EP-A-0,430,098 and GB-A-2,226,156 describe developer stations having a developer chamber with developer rollers arranged therein, via which developer mixture having the printing-toner concentration is fed to a developer gap. Moreover, the developer stations contain a mixing chamber, in which excess developer is mixed with fresh toner, and a developer-station sump having a mixer which is arranged therein and via which depleted developer mixture and enriched developer mixture are mixed to form a developer mixture having the printing-toner concentration.

When developer stations of this type are used in electrophotographic printing machines, in which images of widely varying image density and composition have to be tinted in any sequence, a problem which arises during the tinting, inter alia on account of the sharply fluctuating toner consumption, is the insufficient long-term stability of the mixing-in of the toner and the fluctuating triboelectricity. Where electrophotographic printing machines are concerned, the degree of tinting of the charge image is determined, for example by means of a test toner mark on the photoconductor, and fresh toner is fed to the developer station in dependence on the toner consumption. However, the mixing-in of fresh toner impairs the triboelectric charging of the developer mixture. A further problem is the sharply fluctuating toner consumption, for example when large image surfaces suddenly have to be tinted. This can lead to a sudden depletion of the toner concentration in the developer station, before the toner concentration is then increased again and stabilized by the supply of fresh toner.

SUMMARY OF THE INVENTION

The object of the invention is to design a developer station for an electrophotographic printing or copying machine, in such a way that as constant a toner concentration as possible is established in the developer zone, irrespective of the operating load and of the toner consumption.

With regard to the triboelectric charging of the developer mixture, as high a long-term stability as possible is to be guaranteed, irrespective of the toner consumption.

To this end, an improved developer station for an electrophotographic printing or copying machine is provided for the development of charge images generated on a photoconductor. The developer station includes a developer chamber arranged in a region of the photoconductor. The developer chamber has at least one developer roller with a clearance relative to the photoconductor, the clearance forming a developer gap; an access region which receives a developer mixture having a printing-toner concentration; a metering means and an outlet region. The metering means meters the developer mixture being fed to the developer gap via at least one of the developer rollers. Excess developer is divided off during metering and diverted out of the developer chamber via an overflow channel. The outlet region diverts from the developer chamber the developer mixture depleted as a result of development. The developer station also includes a mixing chamber coupled to the overflow channel. An access region for fresh toner is provided in the mixing chamber. A mixing chamber containing means is provided to mix the excess developer with fresh toner, producing an enriched developer mixture. A developer-station sump receives the enriched developer mixture from the mixing chamber. The sump is coupled to the access region and to the outlet region of the developer chamber. The sump has a vortex-generating means via which a vortex is generated, swirling the depleted developer mixture together with the enriched developer mixture and intermediately storing it. The generated vortex is in a space not occupied by the vortex generating means. From the vortex, developer mixture having the printing-toner concentration is extracted and fed to the developer chamber.

In an embodiment, a pair of magnetic developer rollers are provided which are magnetic. The rollers have direction of rotation opposite a rotational direction of the photoconductor.

In an embodiment, a shielding plate separates the developer chamber from the mixing chamber. Also, the shielding plate is made of ferromagnetic material.

In an embodiment, the metering means includes lateral stripping elements arranged with and a metering roller in a region of feed of the developer mixture to the developer gap.

In an embodiment, a plurality of guide elements are arranged in the mixing chamber for transverse intermixing of excess developer and fresh toner.

In an embodiment, guide elements are arranged in the outlet region of the developer chamber for transverse intermixing of the depleted developer mixture. Furthermore, a stripping element is provided for the associated developer roller.

In an embodiment, a paddle roller is arranged in the developer-station sump as a vortex and transport means, with paddle elements arranged on its circumference.

In a related embodiment, the paddle roller includes an internal transport helix which is designed to move the developer mixture in the paddle roller in the an axial direction relative to the paddle-roller middle.

In an embodiment, a device is provided for sealing off the mixing chamber relative to the photoconductor.

In an embodiment, a suction device is provided to suction off toner dust.

In an embodiment, the developer mixture is electrically conductive and has two components: toner particles and ferromagnetic carrier particles. The developer mixture has a predetermined breakdown field-strength value.

In an embodiment, a means is provided for generating an electrical field in the developer gap, a field strength of which exceeds the breakdown field-strength value of the developer mixture.

Also, the present invention provides a process for the development of charge images generated on a photoconductor in an electrophotographic printing or copying machine. A mixture vortex is generated in a developer-station sump. The mixture vortex serves as a developer-mixture buffer store and is generated by with a vortex-generating means in a space not occupied by the vortex-generating means. The mixture vortex mixes a developer mixture enriched with fresh toner with a developer mixture depleted as a result of the development process. The developer mixture is extracted continuously from the mixture vortex. The extracted developer mixture is transformed by metering into a mixture carpet of predetermined width and thickness. This mixture carpet is guided through a developer gap adjacent to the photoconductor and is introduced as a depleted developer mixture into the developer-station sump. In an embodiment, when appropriate, the excess developer mixture separated during the metering is enriched with fresh toner, depending on the toner consumption, and is fed to the developer-station sump.

The developer station according to the invention has, in principle, two developer circuits. One circuit serves for receiving fresh toner into the developer station or for intermixing fresh toner into the developer mixture contained in the developer station. A second circuit serves for the actual tinting of the charge images in the developer zone on the photoconductor. The circuits are not completely separate from one another, but there are, in principle, two regions of contact, in which the circuits merge into one another or are intermingled. Thus, there is generated in the region of the developer-station sump, below the mixing chamber receiving the fresh toner, a vortex in which developer mixture having essentially the printing-toner concentration is swirled together with developer mixture which has a toner excess. A mixing of depleted developer mixture from the developer gap together with developer mixture having the printing-toner concentration takes place in the region of the paddle roller.

Possibly high toner consumptions are briefly compensated by the toner excess in the vortex which has inter alia the function of a buffer store.

Because the developer station has essentially two developer circuits, a stronger activation of the developer mixture and therefore quicker and higher triboelectric charging are obtained.

Long-term constancy of the tribolecetric charge results inter alia from the compensation of a higher toner consumption possibly occurring from the vortex, in which the carrier particles and toner particles are already partially activated triboelectrically and which only partly contains fresh non-activated toner.

Sudden toner consumptions are compensated by the consumption of the excess toner in the vortex under the mixing chamber. The toner-conveying system is consequently not briefly overloaded.

An electrically conductive two-component developer mixture of toner particles with ferromagnetic carrier particles having a predetermined breakdown field-strength value can be used advantageously in the developer station. It is thereby possible to apply in the developer gap an electrical field, the field strength of which exceeds the breakdown field-strength value of the developer mixture, the result of this being that the developer becomes conductive. This improves the large-surface tinting. This operation is described in U.S. Pat. No. 4,076,857.

BRIEF DESCRIPTION OF THE DRAWINGS

An embodiment of the invention is shown in the drawing and is described in more detail below by way of example. In the drawings.

As illustrated in FIG. 1, a photoconductor or a photoconductor drum 10 is arranged as a charge-image carrier in a printing machine (not shown in detail here) and working on the electrophotographic principle. A charge image is applied to this photoconductor drum 10 in a known way via an exposure device controlled in a character-dependent manner, and this charge image is then tinted by means of the developer station illustrated. The tinting takes place on the principle of reversal development, in which the regions of the charge image which are discharged as a result of exposure are tinted by means of a developer mixture 11 consisting of toner particles and of carrier particles. After passage through the developer station, the toner images obtained as a result of the tinting of the charge image are transferred onto a recording carrier in the usual way. The developer station consists essentially of a developer chamber 12 which is arranged in the region of the photoconductor 10 as well as of a mixing chamber 13 adjacent to the developer chamber 12 and of a developer-station sump 14 formed underneath the developer chamber and mixing chamber.

Developer Chamber

Figure 1:
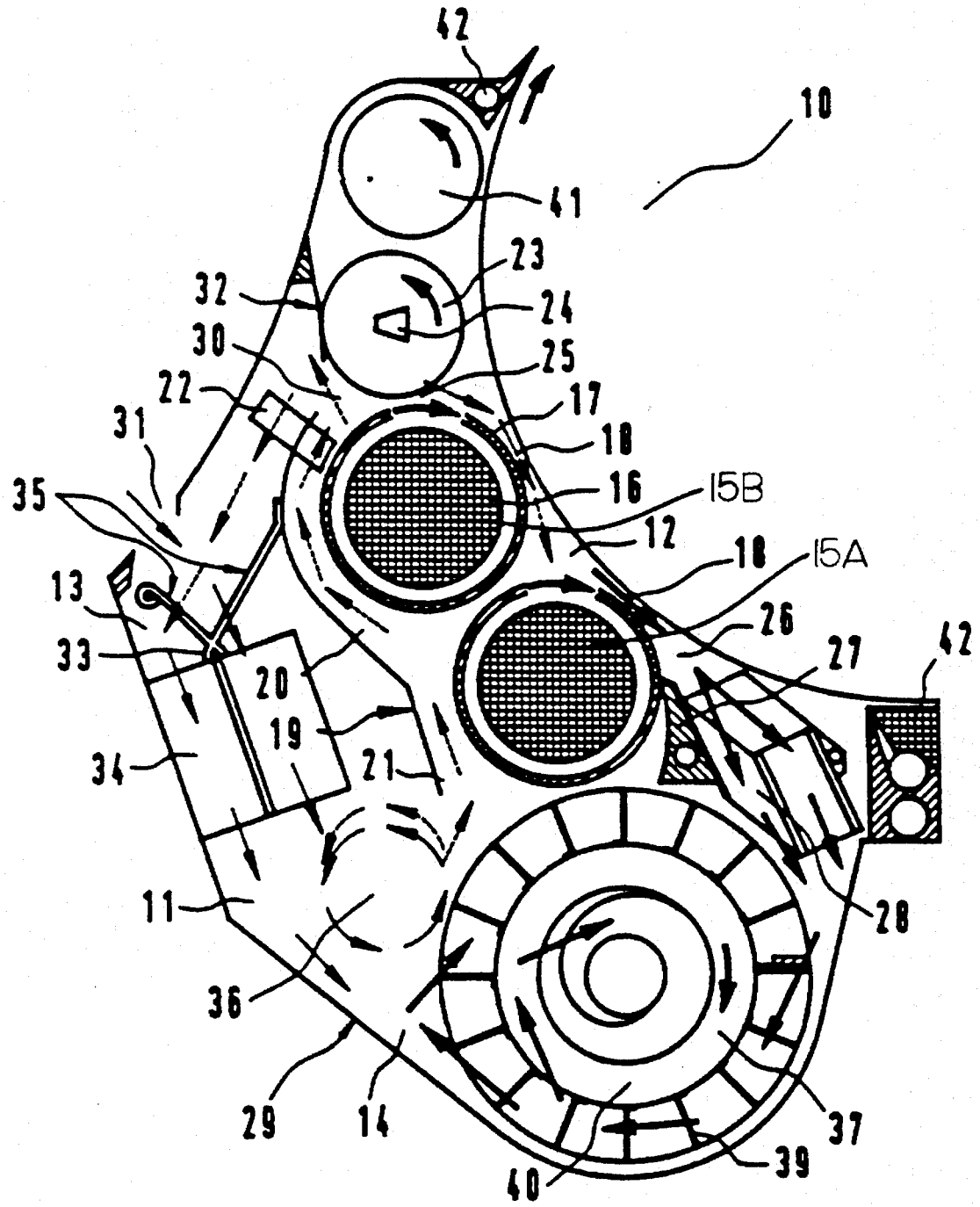
FIG. 1 shows a diagrammatic sectional representation of the developer station according to the invention in an electrophotographic printing machine.

The developer chamber 12 contains two magnetic rollers 15A and 15B arranged next to one another and designed in the usual way. They each contain a permanent-magnet core 16 and a rotatable roller 17 surrounding the permanent-magnet core. The orientation of the ferromagnetic carrier particles of the developer mixture 11 along the flux lines of the magnetic rollers gives rise to a developer-mixture brush which, according to the selected direction of rotation of the magnetic rollers, passes with its tips through a developer zone or developer gap 18 located between the magnetic rollers 15A and 15B and the photoconductor drum 10. The tips of the brushes touch the photoconductor drum 10 and thus transfer the toner particles onto the surface of the photoconductor 10 according to the charge image applied there. Since the direction of movement of the magnetic rollers 15A and 15B is selected opposite to the direction of movement of the photoconductor drum 10 (arrows in FIG. 1), this type of development is referred to as opposed development. The developer chamber 12 is closed off relative to the mixing chamber 13 by means of a shielding plate 19 made of ferromagnetic material. At the same time, the shielding plate 19 is arranged with a clearance relative to the magnetic rollers 15A and 15B, said clearance forming a feed channel 20. The feed channel 20 opens out, opposite the developer-station sump 14, in an access region 21 for the developer mixture which is fed to the magnetic rollers 15A and 15B via the access region 21. Located in the region of entry to the developer gap 18 between the magnetic roller 15B and photoconductor drum 10 is a metering device which fixes the width and thickness of the developer mixture fed to the developer gap in the form of a mixture carpet. The metering device contains lateral strippers 22 which are arranged on both sides of the magnetic roller 15B and which fix with their stripping lips the width of the mixture carpet along the circumference of the magnetic roller 15B, as well as a metering roller 23 moved in the direction of run of the photoconductor drum 10 and consisting of transparent plastic with an internal red-light source 24 (LED strip). The metering roller has two functions: On the one hand, a metering gap 25 defining the thickness of the mixture carpet is fixed by the clearance between the metering roller 23 and magnetic roller 15B, and on the other hand the red-light source 24 discharges the parts of the photoconductor drum 10 not tinted with toner and thus makes it easier to transfer the toner images onto the recording carrier.

The developer mixture depleted as a result of development and coming from the developer gap 18 is fed to the developer-station sump 14 via an outlet region 26 of the developer chamber 12. Located in the outlet region 26 are a stripping wiper 27 with a stripping blade which strips off the developer mixture adhering to the magnetic roller 15A and a front mixing device 28 which consists of guide plates and which ensures a transverse intermixing of the developer mixture by means of inclined guide plates.

Mixing Chamber

Figure 2:
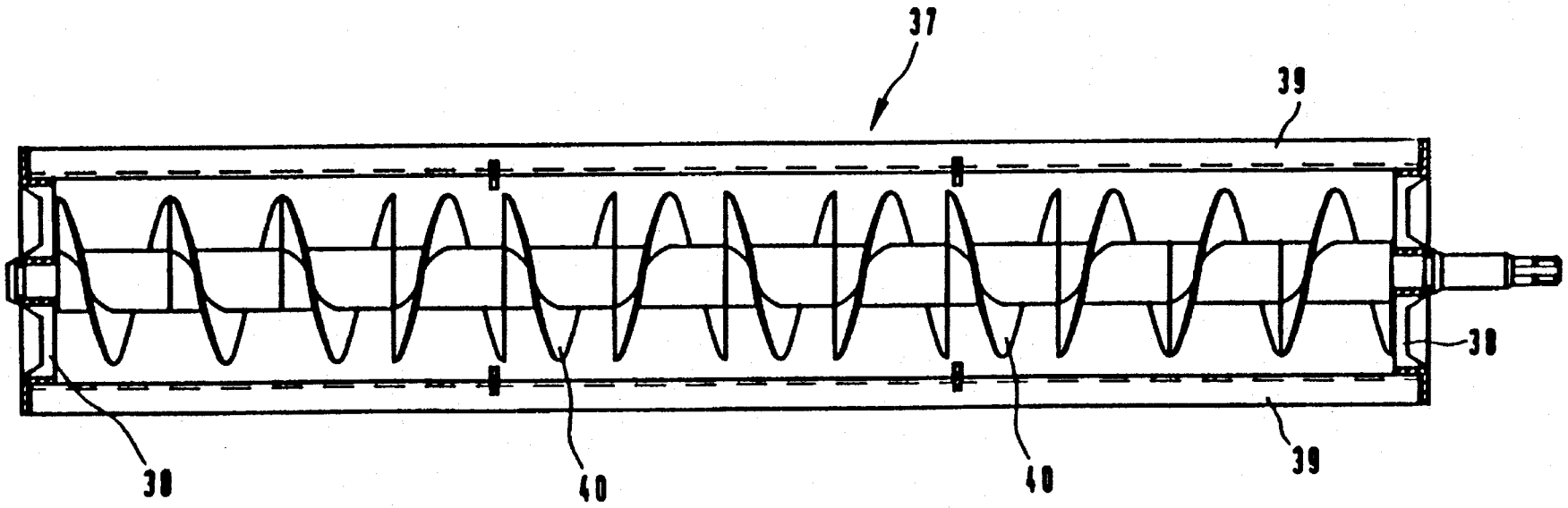
FIG. 2 shows a diagrammatic representation, partially in section, of a paddle roller used in the developer station.

The mixing chamber 13 adjacent to the developer chamber 12 is limited, on the one hand, by a housing wall 29 of the developer station and, on the other hand, by the shielding plate 19. It is coupled in its upper part to the developer chamber 12 via an overflow channel 30 and furthermore possesses, likewise in the upper part, a feed orifice 31 for fresh toner. It is closed off relative to the metering roller 23 via an elastic sealing lip 32. The mixing chamber contains a rear mixing device 33 in the form of transversely or obliquely set mixing plates 34 and guide plates 35, coupled to the mixing plates 34, for the developer mixture. The mixing device 33 of the mixing chamber mixes developer mixture having the printing-toner concentration, received from the developer chamber 12 via the overflow channel 30, with fresh toner received via the feed orifice 31 and supplies the mixture thus obtained to the developer-station sump 14, a mixture vortex 36, the function of which is explained below, being generated in the outlet region of the mixing chamber 13 to the developer-station sump 14. Developer Station Sump Referring to FIGS. 1 and 2 generate the mixture vortex 36 and to convey the developer mixture 11 to the access region 21 of the developer chamber 12, a paddle roller 37 is arranged within the developer-station sump. This paddle roller 37 is driven via an electric motor, and it extends over the entire width of the developer station and consists essentially of two lateral web wheels 38 with plate-like paddle elements 39 arranged on them. Located within the paddle elements 39 arranged on the circumference of the paddle roller 37 is a transport helix 40 coupled to the web wheels 38 and taking the form of a transport screw. The pitch direction of the transport helix 40 serving as conveying elements is selected so that the developer mixture penetrating between the paddle elements 39 and laterally via the web wheels 38 is transported towards the middle of the developer station, where it emerges again from the paddle roller 37 between the paddle elements 39. The developer mixture is thereby intermixed transversely in the region of the developer sump 14.

Function of the Developer Station

In principle, two developer-mixture circuits are generated by means of the developer station, namely a first developer circuit which serves for receiving fresh toner into the developer mixture and a second developer circuit in which the actual development of the charge image takes place. Thus, in principle, three developer mixtures are obtained, namely a first developer mixture indicated in FIG. 1 by broken lines and having the printing-toner concentration, a second developer mixture indicated by thin, unbroken lines and consisting of fresh toner and a slighty depleted developer mixture indicated by thick lines and consisting of slightly depleted developer mixture.

First Developer-Mixture Circuit

The majority of the developer mixture is located in the developer-station sump 14 which consists of a trough-shaped formed-out portion of the housing. It is intermixed there by the paddle roller 37. Sixteen paddle elements 39 (battens) of the paddle roller 37 transport it via the access region 21 into the feed channel 20 of the developer chamber 12. This receives some of the developer mixture by means of the magnetic rollers 15A and 15B, whilst the excess developer mixture falls onto the transport helix 14 of the paddle roller and is conveyed by this to the middle of the developer station. As a result of the rotational movement of the roller of the magnetic roller 15A, the developer mixture is transported to the magnetic roller 15B and received by the latter. The rotor (roller) of the magnetic roller 15B conveys the developer mixture to the lateral strippers 22. Stripping off the excess developer mixture fixes the width of the mixture carpet which then flows into the developer gap (developer zone) 18. The thickness of the mixture carpet is determined via the metering roller (23). The developer mixture is pressed through the metering gap 25 and passes as a mixture carpet of exactly defined width and thickness into the developer gap (18) (developing zone), whilst the excess divided-off developer mixture passes via the shielding plate 19 and the guide plates 35 into the mixing device 33. Through the feed orifice 31 located above the latter, fresh toner is supplied to the mixing chamber 13 via a corresponding conveying device in dependence on the established toner concentration in the developer mixture and is intermixed transversely with the stripped off excess developer mixture by means of the mixing device 33 with its mixing plates 34. The developer mixture thus intermixed passes into the region of the paddle roller 37, and at the same time the mixture vortex 36 is generated, on the one hand as a result of the direction of feed of the developer mixture out of the mixing chamber into the developer sump and by means of the movement of the paddle roller 37.

So that the stream of developer mixture can trickle freely in the mixing device 33, the shielding plate 19 is arranged as a partition element between the developer chamber 12 and the mixing chamber 13. The flux lines of the magnetic rollers 15A and 15B close via the ferromagnetic shielding plate 19 and therefore no longer influence the developer located behind it.

Second Developer-Mixture Circuit

In the second developer-mixture circuit, deve loper mixture having the printing-toner concentration is extracted from the mixture vortex 36 via the paddle roller 37 and is fed, as described, to the magnetic rollers 15A and 15B. After metering via the metering device and passage through the developer gap 18, the developer mixture is stripped off via the stripping wiper 37 and the developer mixture trickles into the front mixing device 28, where it is intermixed transversely, in order to compensate a possible unequal consumption of toner along the width of the developer station. The developer mixture depleted as a result of passage through the developer gap 18 trickles out of the front mixing device 28 into the region of the paddle roller 37, is taken up by the latter and is mixed in the way described with the developer located in the developer-station sump 14.

As already described, developer mixtures having three different toner concentrations are obtained in the developer station: A developer mixture having a slightly high concentration in the region of the rear mixing device 33 as far as the paddle roller 37; a developer mixture having the printing-toner concentration in the region of the paddle roller 37, magnetic rollers 15A, 15B, metering roller 23 or rear mixing device 33; furthermore, a developer mixture having a lower toner concentration in the exit region of the magnetic rollers 15A, 15B in the region of the front mixing device 28 and of the paddle roller 37.

In order to intermix these three types of developer mixture defined according to their toner concentration, there are, in principle, two junction points: namely, the mixture vortex 36 under the shielding plate 19—here, developer mixture having the printing-toner concentration is mixed with that having the higher toner concentration—and a junction point in the region of the paddle roller 37. Here, developer mixture having the printing-toner concentration is mixed with a developer mixture slightly depleted as a result of the development process.

A constant toner concentration is obtained in the developer gap 18 both geometrically over the width of the developer station and over time by means of the two developer-mixture circuits and junction points.

Possible suddenly high toner consumptions as a result of large-surface tinting which suddenly occurs are compensated by the consumption of the excess toner in the mixture vortex 36 under the rear mixing device 33. As a result, the toner-conveying system is not briefly overloaded. If the toner consumption is low, only a little toner is fed into the developer station and the toner concentration is thus gradually compensated.

The first developer-mixture circuit serving essentially for receiving fresh toner also serves for the additional triboelectrical activation of the developer mixture. A triboelectric charging of the developer mixture which is virtually independent of the toner consumption is thereby obtained.

In addition, the developer station contains above the metering roller, in the exit region of the photoconductor drum 10 from the developer station, a carrier-catching roller 41 which has a permanent magnet with a rotating roller casing. The carrier-catching roller 41 detaches carrier particles possibly adhering to the photoconductor drum 10 and throws them back into the developer station.

The continuous movement and intermixing of the developer mixture gives rise to toner dust inside the developer station. So that this does not pollute the environment by escaping, appropriate protective devices are provided in the developer station. These consist essentially of the sealing lip 32 which partitions off the fresh-toner feed region from the photoconductor drum 10. Furthermore, located in the upper region of the developer station is a suction orifice 42 which suctions off by means of a suction device the toner dust occurring in the upper region of the developer station. A similar suction device is arranged in the region of the front mixing device 28. It suctions off the toner dust occurring in the region of the mixing device 28.

In the above-described exemplary embodiment of the developer station, two magnetic rollers are provided as developer rollers. It is also possible, however, to use a single larger magnetic roller or a plurality of magnetic rollers arranged next to one another. It is conceivable, furthermore, to replace the magnetic rollers by other mechanical applicator means, for example paddle elements or short-pile brushes. A paddle roller is provided as a vortex-generating means in the developer sump. The paddle roller can, if appropriate, be replaced by a magnetic roller or by other mechanical swirling and transport means, for example in the form of a pin roller or other rollers having a rough surface transporting the developer mixture. As regards the photoconductor, in the exemplary embodiment this is designed as a photoconductor drum. However, a photoconductor band can also be used as a photoconductor. A single-component developer mixture can also be employed instead of the two-component developer mixture.

The developer station is particularly suitable for employing a two-component developer mixture of high conductivity with a low resistance of approximately 108–109 ohm, which has a predermined breakdown field-strength value. At the same time, an electrical field, the field strength of which exceeds the breakdown field-strength value of the developer mixture, is applied in the developer gap 18 by means of a bias voltage. This phenomenon is described in detail in U.S. Pat. No. 4,076,857.

Although other modifications and changes may be suggested by those skilled in the art, it is the intention of the inventors to embody within the patent warranted hereon all changes and modifications as reasonably and properly come within the scope of their contribution to the art. Furthermore, each of the aforementioned patents is incorporated herein by reference in its entirety.

What is claimed is:

1. A developer station for an electrophotographic printing or copying machine for the development of charge images generated on a photoconductor, comprising:

a developer chamber which is arranged in the region of the photoconductor, the developer chamber having:

at least one developer roller with a clearance relative to the photoconductor, said clearance forming a developer gap;

an access region receiving a developer mixture having a printing-toner concentration;

metering means for metering the developer mixture for producing a metered developer mixture which is fed to the developer gap via at least one of the developer rollers, said metered developer mixture being depleted in said developer gap and thereby producing depleted developer mixture, said metering means producing excess developer divided off during metering;

an overflow channel disposed to received said excess developer and to divert it out of the developer chamber;

an outlet region for diverting the depleted developer mixture depleted out of the developer chamber;

a mixing chamber coupled to the over flow channel and having an access region for fresh toner, the mixing chamber containing means for mixing the excess developer with the fresh toner and thereby producing an enriched developer mixture; and a developer-station sump disposed to receive the enriched developer mixture from the mixing chamber and coupled to the access region and to the outlet region of the developer chamber, said developer-station sump containing vortex-generating means for producing vortex for swirling the depleted developer mixture together with the enriched developer mixture to produce said developer mixture and for intermediately storing said developer mixture in a space which is not occupied by the means for producing a vortex and from which said developer mixture having the printing-toner concentration is extracted and fed to the developer chamber.

2. The developer station as claimed in claim 1, a pair of developer rollers which are magnetic, having a direction of rotation in the developer gap which is opposite to the direction of movement of the photoconductor.

3. The developer station as claimed in claim 1, further comprising:

a shielding plate separating the developer chamber from the mixing chamber, said shielding plate being made of ferromagnetic material.

4. The developer station as claimed in wherein the metering means comprises:

lateral stripping elements; and a metering roller arranged with the lateral stripping elements in a region of feed of the developer mixture to the developer gap.

5. The developer station as claimed in claim 1, further comprising:

a plurality of guide elements arranged in the mixing chamber for transverse intermixing of excess developer and fresh toner.

6. The developer station as claimed in claim 1 further comprising:

guide elements arranged in the outlet region of the developer chamber for transverse intermixing of the depleted developer mixture; and a stripping element for the associated developer roller.

7. The developer station as claimed in claim 1 further comprising:

a paddle roller, arranged in the developer-station sump, as a vortex and transport means, with paddle elements arranged on its circumference.

8. The developer station as claimed in claim 7, wherein the paddle roller includes an internal transport helix to move the developer mixture in the paddle roller in an axial direction.

9. The developer station as claimed in claim 1 further comprising:

a device sealing off the mixing chamber relative to the photoconductor.

10. The developer station as claimed in claim 1, further comprising:

a suction device to suction off toner dust.

11. The developer station as claimed in claim 1, wherein the developer mixture is electrically conductive and comprises toner particles and ferromagnetic carrier particles, the developer mixture having a predetermined breakdown field-strength value.

12. The developer station as claimed in claim 11, further comprising:

a means for generating an electrical field in the developer gap, a field strength which exceeds the breakdown field-strength value of the developer mixture.

13. A process for the development of charge images generated on a photoconductor in an electrophotographic printing or copying machine, comprising the following steps:

generating a mixture vortex in a developer-station sump, said mixture vortex serving as a developer-mixture buffer store with a vortex-generating means, in a space not occupied by the means, said mixture vortex mixing a developer mixture enriched with fresh toner and from a developer mixture depleted as a result of the development process, continually extracting the developer mixture from the mixture vortex, metering the extracted developer mixture into a mixture carpet of predetermined width and thickness, guiding the mixture carpet through a developer gap adjacent to the photoconductor introducing the mixture carpet a depleted developer mixture into the developer-station sump.

14. The process according to claim 13 further comprising:

separating excess developer during the metering step;

enriching said excess developer with fresh toner; and feeding said enriched developer to the sump.

15. A developer station for a copying machine comprising:

a developer chamber including a photoconductor;

at least one developer roller separated from said photoconductor by a developer gap;

an access region containing a developer mixture having a desired printing-toner concentration;

a metering device to feed the developer mixture to the developer gap along at least one of the developer rollers;

an outlet region carrying depleted developer mixture exiting the developer chamber;

a mixing chamber mixing excess developer mixture from said metering device with fresh toner, forming an enriched developer mixture;

a sump receiving the enriched developer mixture from the mixing chamber, the sump further being in communication with the access region and with the outlet region of the developer chamber;

a vortex generator in the sump generating a vortex in a space adjacent said vortex generator, said vortex swirling the depleted developer mixture together with the enriched developer mixture, the vortex intermediately storing the developer mixture prior to its being supplied to the developer chamber.

16. The developer station according to claim 15 wherein the vortex generator comprises:

a helix shaft rotatably disposed in said sump; and a plurality of paddle elements longitudinally disposed on said helix.

17. The developer station according to claim 16 wherein the vortex generator further comprises:

at least one webbed wheel secured to an end of said helix to rotate therewith, each wheel having spaced webs set at a pitch to provide a flow of the developer mixture axially toward the rotating helix.

18. The developer station according to claim 16 wherein said vortex generator is positioned in said sump so that on one side of said vortex generator said paddle elements pass closely by a wall of said sump.

* * * * *